United States Patent [19]

Marach

[11] Patent Number: 4,872,262

[45] Date of Patent: Oct. 10, 1989

[54] HOLDER FOR A BLADE-TYPE CIRCUIT ELEMENT

[75] Inventor: David R. Marach, Marengo, Ill.

[73] Assignee: Cooper Industries, Inc., Houston, Tex.

[21] Appl. No.: 232,322

[22] Filed: Aug. 15, 1988

[51] Int. Cl.[4] ..... H01R 43/00

[52] U.S. Cl. ..... 29/884; 29/874; 439/621; 439/830; 439/885

[58] Field of Search ..... 29/874, 876, 882, 884; 439/885, 621, 830

[56] References Cited

U.S. PATENT DOCUMENTS

| | | | |
|---|---|---|---|
| 2,116,269 | 5/1938 | Kobzy | 29/874 |
| 3,140,364 | 7/1964 | Swanke et al. . | |
| 3,457,640 | 7/1969 | Rayburn | 29/884 |
| 3,618,207 | 11/1971 | Sand et al. . | |
| 4,197,636 | 4/1980 | Osanai . | |
| 4,337,574 | 7/1982 | Hughes et al. | 29/884 X |
| 4,616,416 | 10/1986 | Cabaud | 29/884 |
| 4,712,299 | 12/1987 | Loewen et al. | 439/885 X |
| 4,722,701 | 2/1988 | Bradt . | |

*Primary Examiner*—Joseph M. Gorski
*Attorney, Agent, or Firm*—Haight & Hofeldt

[57] ABSTRACT

A holder and method of forming a holder for a removable plug-in circuit element is disclosed. The fuse holder comprises an insulated base, an electrical bus member, and a plurality of terminal members which are formed from the same blank of metal as the metal bus member and which were separated from each other after that blank was mounted on the insulated base. The bus member comprises a plurality of branches joined to a common trunk with each branch having at its free end an integral terminal. Each terminal member has at one end an electrical terminal and, at an opposite end, an integral terminal which is aligned to the free end of one lateral branch. In one embodiment of the invention, the holder includes an insulated cover which is carried by the base and which has a plurality of apertures which aligned to the terminals of each branch so as to receive the ends of a removable plug-in circuit element therein.

22 Claims, 4 Drawing Sheets

FIG. 1
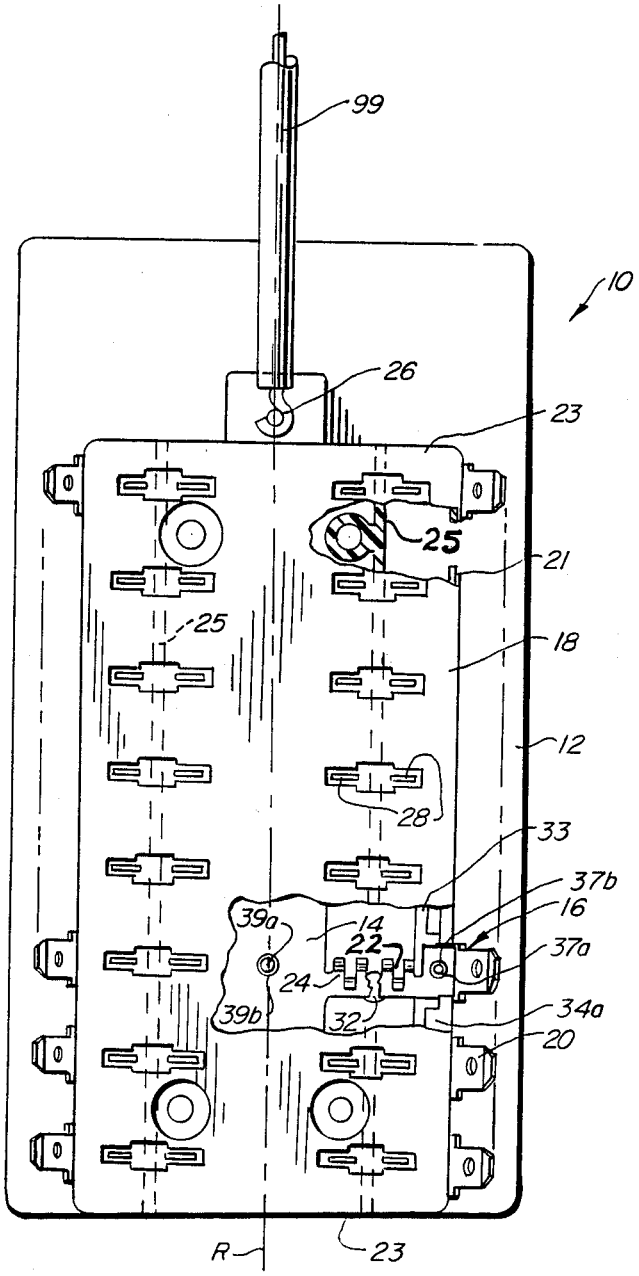
FIG. 2
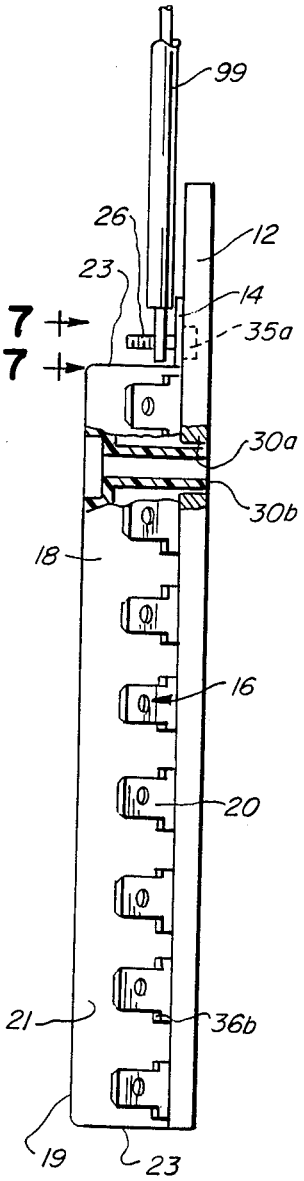
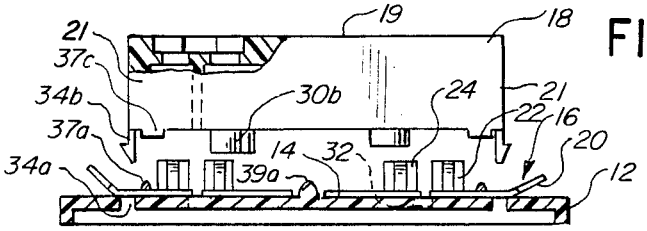
FIG. 3

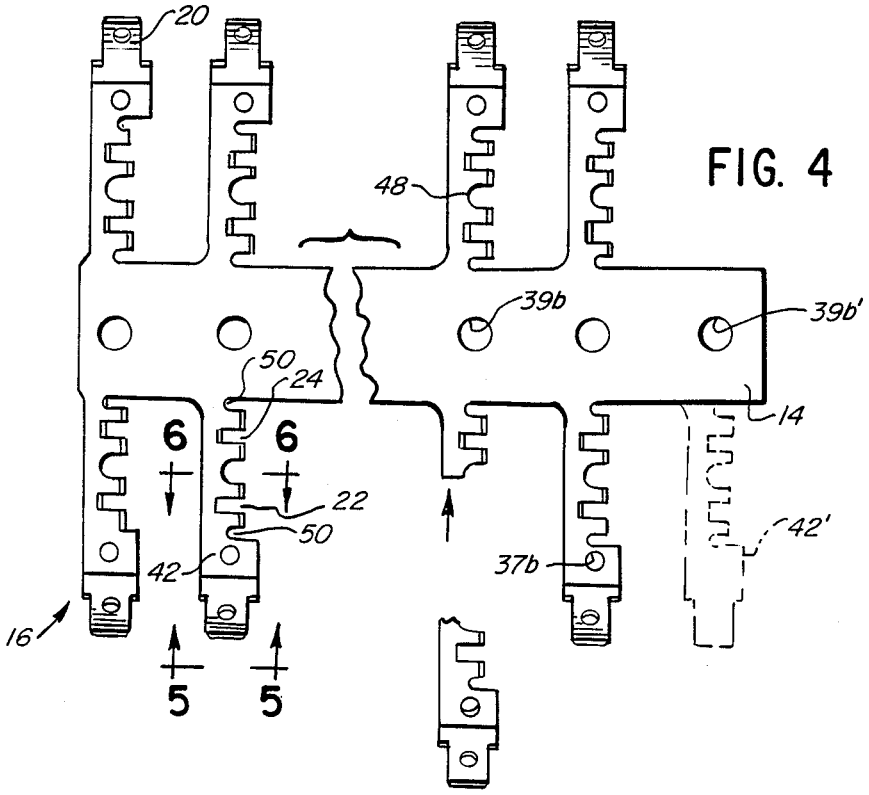
FIG. 4
FIG. 5
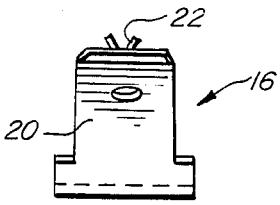
FIG. 6
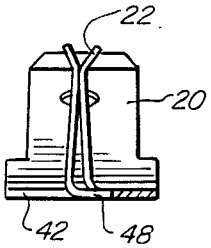
FIG. 7
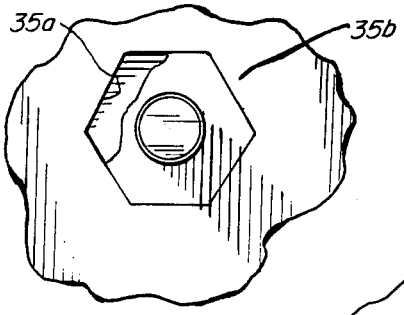
FIG. 8
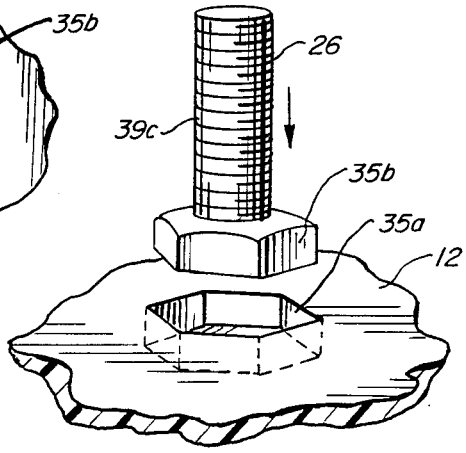

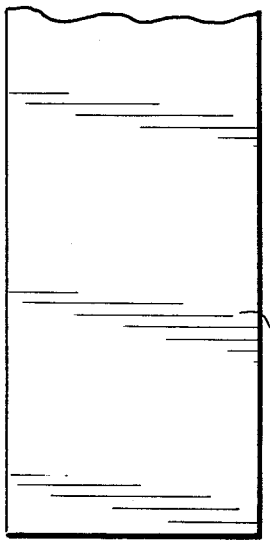
FIG. 9
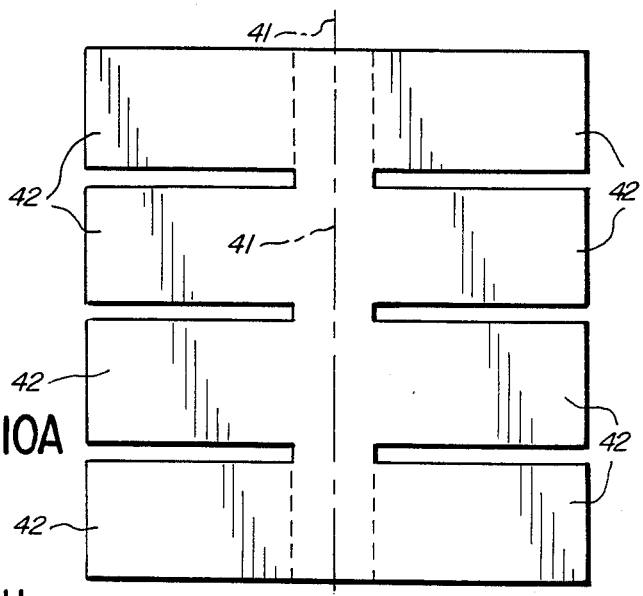
FIG. 10A
FIG. 10
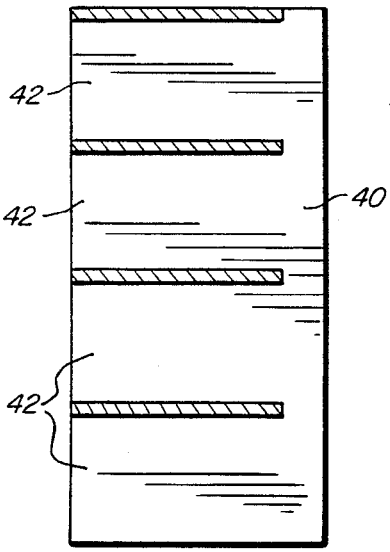
FIG. 11
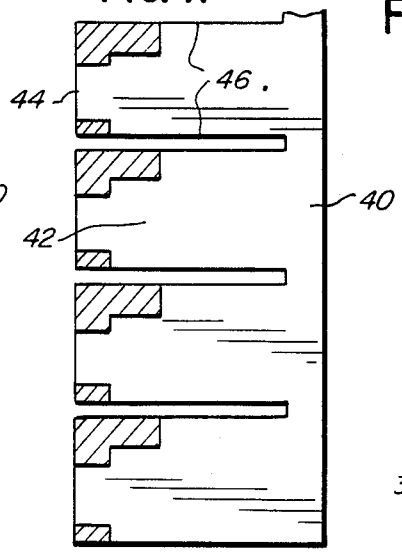
FIG. 12
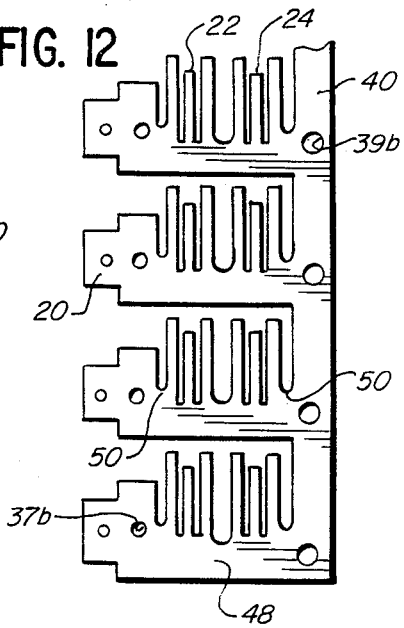
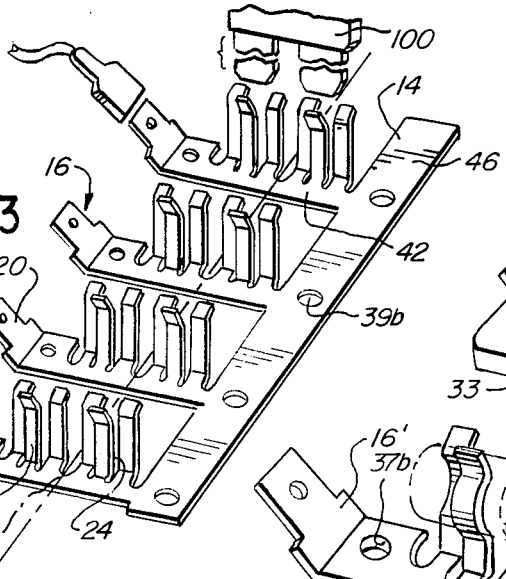
FIG. 13
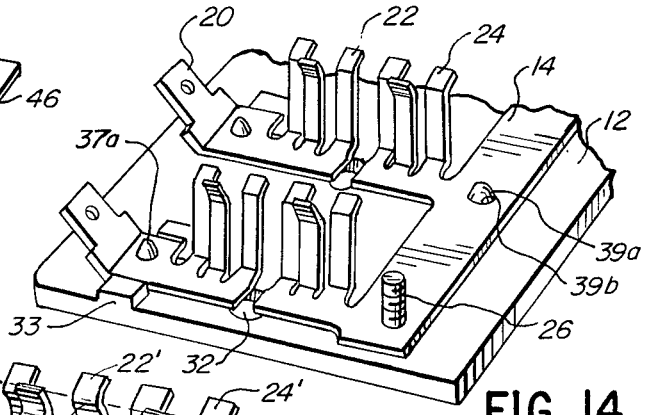
FIG. 14
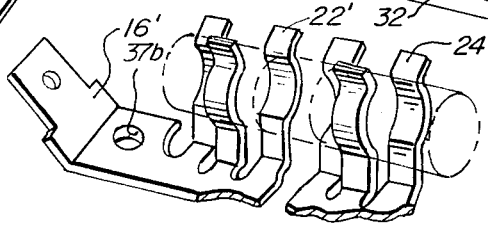
FIG. 14A

HOLDER FOR A BLADE-TYPE CIRCUIT ELEMENT

TECHNICAL FIELD

This invention relates to holders for removeable circuit elements and fuse blocks, in general, and to fuse blocks and holders for replaceable circuit elements having blade-type terminals, in particular.

BACKGROUND OF THE INVENTION

Plug-in fuses are disclosed in U.S. Pat. No. 3,909,767 and 3,962,782. Such a fuse comprises a plug-in fuse element which includes: a blade-like body of fuse metal having a pair of laterally spaced terminal blade portions to be received by pressure clip terminals in a mounting panel or fuse block; current-carrying extensions at the inner end portions of each terminal blade portion; and a fuse link portion, generally of reduced thickness and small cross-sectional area, for interconnecting the current-carrying extensions. These fuses are alternatively referred to as "ATC" fuses (ATC is a registered trademark of Cooper Industries, Inc.) and have found widespread use in electrical systems found in automobiles, motorboats and other products.

Plug-in fuses are used in conjunction with pressure clip terminals which are carried in a fuse mounting panel or by a fuse block. Generally speaking such a panel or block comprises an insulated base to which are attached pairs of terminals, each pair of terminals comprising a fuse holder. Usually one side of each fuse holder is connected to a source of power and the other side is connected to the electrical device which is protected by the fuse. The terminals are, for the most part, individually mechanically attached to the insulated base by rivets, screws, threaded fasteners and the like. Sometimes, snap-in connections, pressure gripping tabs, or heat staking is used to hold the fuse terminal on the base.

It can be appreciated from the foregoing description that the manufacture, construction, and assembly of a fuse block, especially an ATC fuse block, is difficult and labor intensive. Since the parts are small, a premium is placed on the manual dexterity of the assembler. Thus, the manufacture of ATC fuse blocks involves the use of semi-skilled workers. The use of multiple, small, dimension sensitive parts also adds to the cost of manufacturing a fuse block.

With the wide-spread acceptance of ATC fuses in mass produced products, such as automobiles and pleasure craft, there is a need for a cost-saving method of assembling a fuse block for plug-in fuses, a fuse block which is easy to assemble, one which is easily adoptable to automated assembly, and one which has fewer assembly steps.

SUMMARY OF THE INVENTION

In accordance with the present invention, a fuse holder and method of forming a fuse holder is disclosed. Specifically, the fuse holder comprises an insulated base, an electrical bus member carried by the base and a plurality of fuse terminal members which were formed from the same blank of metal as the electrical bus member and which were separated from each other after that blank was mounted on the insulated base. The bus member comprises a plurality of lateral branches joined to a common trunk with each branch having at its free end one integral fuse accepting terminal. Each fuse terminal member has, at one end, an electrical terminal for receiving an electrical connection and, at an opposite end, an integral fuse accepting terminal which is aligned to the free end of one lateral branch. In one embodiment of the invention, the fuse holder includes an insulated cover which is carried by the base and which has a plurality of apertures which are aligned to the fuse terminals of each branch so as to receive at least the ends of the fuse therein.

The fuse holder just described is preferably made by: forming from a generally flat blank of metal a plurality of generally parallel branches which are separated from each other by space distance; forming along one edge of each branch a pair of pressure clip terminals which are adapted to receive the blade portions of a plug-in fuse; mounting the formed blank of metal on an insulated base; and severing each branch at a position between the pair of pressure clip terminals, whereby those pressure clip terminals of each branch which are joined to the trunk member form a common electrical bus.

From the foregoing description it will be seen that the fuse holder can be formed using a minimal number of steps makes economical use of material, does not require highly skilled assembly workers, is adapted to automatic manufacturing processes, and represents a cost-effective and improved method of manufacture.

Numerous other advantages and features of the present invention become readily apparent from the following detailed description of the invention and the embodiments thereof, from the claims and from the accompanying drawings.

BRIEF DESCRIPTION OF THE DRAWINGS

FIG. 1 is a top plan view of the fuse holder that is the subject of present invention:

FIG. 2 is a partial cross-sectional side view of the fuse holder of FIG. 1;

FIG. 3 is a partial cross-sectional end view of the fuse holder of FIG. 1;

FIG. 4 is a top plan view of the formed metal blank that is used in the fuse of FIG. 1;

FIGS. 5 and 6 are partial side and partial side cross-sectional views of one lateral branch of the blank of FIG. 4, as viewed along lines 5—5 and 6—6, respectfully;

FIG. 7 is an enlarged partial plan view of the threaded terminal at one end of the fuse holder of FIG. 1, as viewed along line 7—7;

FIG. 8 is a partial perspective view of the threaded terminal of FIG. 7, as viewed along line 8—8;

FIGS. 9 through 14 are pictorial representations of a sequence of steps which, when performed, result in the assembly of the fuse block of FIG. 1;

FIGS. 10A, 14A, 15A through 15E, and 16 are representations of alternate embodiments of various features of the invention:

DETAILED DESCRIPTION OF THE PREFERRED EMBODIMENT

Figure 15A:
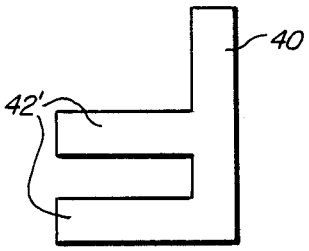
Figure 15B:
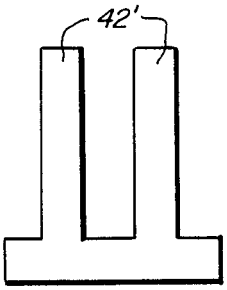
Figure 15C:
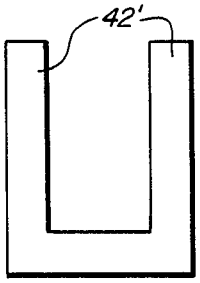
Figure 15D:
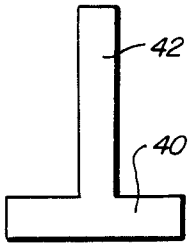
Figure 15E:
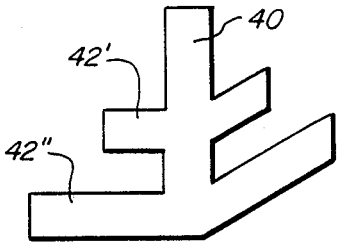
Figure 15F:
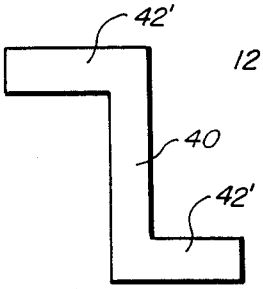

While this invention is susceptible of embodiment in many different forms, there is shown in the drawings and will herein be described in detail several embodiments of the invention. It should be understood, however, that the present disclosure is to be considered as an exemplification of the principles of the invention and is not intended to limit the invention to the specific embodiments illustrated.

Before describing the method to manufacture the fuse holder that is the subject of the present invention, the fuse holder resulting from the method will be described so as to facilitate an understanding of the manufacturing process.

Fuse Block

Turning to FIGS. 1, 2, and 3, the fuse holder 10 that is the subject of the present invention comprises: an insulated base 12, an electrical bus member or terminal plate 14, a plurality of fuse terminal members 16 and an insulated cover 18. Each terminal member 16 has at one end an electrical terminal 20 and at its opposite end, an integral fuse terminal 22. The fuse terminal 22 on the fuse terminal member 16 is aligned and spaced apart from a corresponding fuse terminal 24 on the terminal plate 14. In the particular embodiment illustrated in the drawings, the fuse terminals are pressure clip terminals comprising trifurcations which are adapted to accept the generally flat blade portions of a plug-in fuse. The terminal plate 14, in this particular embodiment is adapted to be connected to an electrical source 99 by means of a threaded fastener 26 and the electrical terminal 20 is a spade quick-connect terminal.

Figure 18A:
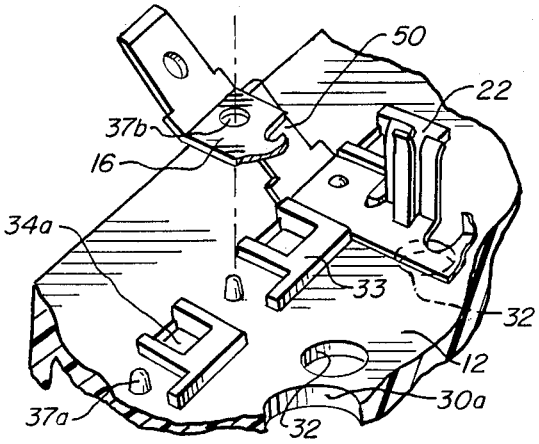
FIGS. 18A and 18B are partial perspective views of two embodiments of the insulated base of FIG. 1.

The insulated base 12 is a generally flat structure (See FIG. 3) made from thermal plastic by injection molding so as to be suitable for mounting thereon the terminal plate 14 and the terminal members 16. The insulated base 12 is provided with a series of mounting apertures 30*a* (See FIG. 2) which can be used to mount the base, die-stamp apertures 32, cover securing apertures 34*a* and hardware mounting apertures 35*a* (See FIG. 8). The base member 12 is also provided with a series of pin-like projections 37*a* and 39*a* which are aligned to corresponding securing apertures 37*b* in the fuse terminal members 16 (See FIGS. 18A and 18B) and apertures 39*b* in the terminal plate 14 (See FIG. 4). To facilitate alignment and to insure that the fuse terminal members 16 are properly located, a plurality of raised recesses 33 are provided on each side of the fuse terminal projections 37*a* (see detail in FIGS. 18A and A8B).

Figure 17:
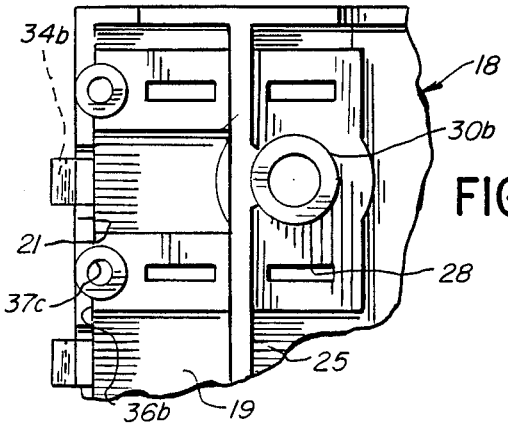
FIG. 17 is a partial bottom plan view of the cover of the fuse holder of FIG. 1.

The cover member 18 is a generally flat, five-sided structure (See FIG. 3) which is made from thermal plastic by injection molding and which includes a top wall 19, two side walls 21, two end walls 23, and two interior barrier walls 25 (see FIG. 17). The top wall 19 has a plurality of fuse accepting apertures 28. The side walls 21 have a plurality of securing tabs 34*b* and recesses 36*b* for the electrical terminals 20, such that the electrical terminals of the fuse terminal members 16 are exposed. The fuse apertures 28 are aligned with the fuse terminals 22 and 24 carried by the insulated base 12. Additional apertures may be provided for electrically connecting one end of the terminal plate 14 at a position outside of the cover. The inside of the cover 18 (see FIG. 17) has two barrier walls 25, tube-like extensions 30*b* to be received by the base mounting apertures 30*a*, and tube-like extensions 37*c* to receive the fuse terminal projections 37*a*.

Method

Turning now to FIGS. 9 through 14, the method of forming the terminal plate 14 will now be described. The terminal plate 14 is die-stamped from a generally flat blank of metal or copper alloy 15, such as a long strip of electrical grade brass. To each side of a common trunk member 40 (see reference line 41) are formed a plurality of generally parallel branches 42. To simplify the drawings (see FIGS. 10 through 14), branches 42 are shown formed only on one side of the trunk number 40. However, it should be understood that branches 42' can be formed to each side or to one side of the trunk member 40 (See FIGS. 15A through 15F), symmetrically or asymmetrically, relative to a base reference line. Moreover, the branches need not be parallel or at right angles to the trunk. Each branch 42 is separated from the others by spaced distance. Each branch has a relatively short free end or distal end 44 and two relatively long edges 46 which join the free end to the trunk member 40 (See FIG. 11). Formed along one long edge 46 of each branch 42 are two fuse securing terminals 22 and 24, each comprising trifurcations. The two fuse terminals 22 and 24 are separated from each other by a lateral section 48 of reduced width (See FIG. 12). Each terminal 22 and 24 is partially separated from the free end 44 and the trunk member 40 by two recesses or channels 50. The purpose of the reduced width section 48 and the recesses 50 will become apparent from the description which follows. At the free end 44 of the branch 42, the electrical connecting terminal 20 is formed. In this particular embodiment, the electrical terminals 20 at the end of each branch 42 are of the well-known quick-connect variety. They provide a complete gripping surface and give good engagement strength. A large contact surface also affords the highest affordable electrical conductivity. Other electrical terminal connecting means may be stamped into each branch, i.e., screw connections, trifurcations, box connector, solder connectors, etc. Here the electrical terminals 20 are formed approximately 45 degrees to the plane of the terminal plate (See FIG. 3).

Each fuse terminal 22 and 24 is formed generally at right angles (See FIG. 13) to the plane of the terminal plate 14. The fuse terminals 22 and 24 are separated from each other by a distance generally equal to the distance between the blade portions of the associated fuse 100. Between the electrical terminal 20 at the free end of each branch and the adjacent fuse terminal 22, a securing aperture 37*b* is formed. Finally, a plurality of apertures 39*b* are formed on the trunk 40. Proper alignment of the formed blank on the insulated base 12 is facilitated by means of cooperating projections 37*a*, and 39*a*, and apertures 37*b* and 39*b* and by means of the cooperating raised insulated recesses 33 (See FIGS. 18A and 18B) and metal recess 50. The apertures 37*b* and 39*b* in conjunction with projections 37*a* and 39*a* on the insulated base 12 facilitate heat staking of the two parts, should that become necessary.

The steps just described are conveniently accomplished using die stamping techniques and metal punching methods much as that used in U.S. Pat. No. 3,140,364. One or more punching steps may be used. FIGS. 9 through 14 are illustrative.

From the foregoing it will also be appreciated that the formed metal blank may be of any length (See FIG. 4) and any number of branches may be formed therein. Here (See FIG. 1) the finished terminal plate 14 has eight branches on each side of a longitudinal reference line "R".

Prior to mounting the terminal plate 14 on the insulated base 12 one pair of lateral branches 42' (See FIG. 4) may be removed. This will allow the trunk to extend out of the cover area so as to provide a convenient point of attachment to a source of power 99. The reduced width lateral section 50 at the proximate end of each branch facilitates easy removal.

Prior to mounting the finished blank on the insulated base 12, a threaded fastener 26 may be mounted onto the base (See FIG. 8). Here the hex-head **35*b* of a bolt is inserted into a corresponding cavity 35*a* in the base 12. The threaded portion 39*c* of the bolt is preferably selected to pass through a corresponding aperture 39*b*' in the terminal plate 14. This allows good electrical contact for all of the fuse protected loads. Of course other means may be used to electrically connect the terminal plate 14. Moreover, the electrical connection may be made inside the protective cover by means of a suitable aperture in one of the end walls 23**.

After the terminal plate 12 is formed, it is mounted on the insulated base 12. The apertures **39*b* on the terminal plate 14 are received by the projections 39*a* on the insulated base 12 and the slots 50 at the ends of each branch fit within the alignment recesses 33 (See FIG. 18A). When so mounted the die stamp apertures 32 are located below the reduced width sections 48 between the two fuse terminals 22 and 24 of each branch 42**. At this point the finished blank may be heat staked in position.

Once the formed blank is mounted on the insulated base, a die stamping machine is used to sever or cut each lateral branch 42 at a position 48 generally midway between the two fuse terminals 22 and 24. The process of die stamping forms a plurality of fuse terminal members 16 and a common bus member 14 in one step (See FIG. 14). Heretofore, the fuse terminal members and bus member were added to the base serially. Such a process is time consuming and requires good manual dexterity if the assembly was to be completed without error and with good quality.

After the fuse terminal members 16 are separated from the common bus member, the cover 18 is installed. Here the cover securing tabs **34*b* are forced into the corresponding apertures 34*a* in the base 12. The tube-like extensions 37*c*, located on the inside of the cover 18, are received by the pins or projections 37*a* on the base, thereby securely holding the fuse terminal members in place. The barrier walls 25 reduce the potential for arcing between the fuse terminals 22 and 24. In addition, the tube-like extensions 30*b* on the inside of the cover 19 fit within apertures 30*a* in the base 12 (See FIG. 2** detail).

Figure 16:
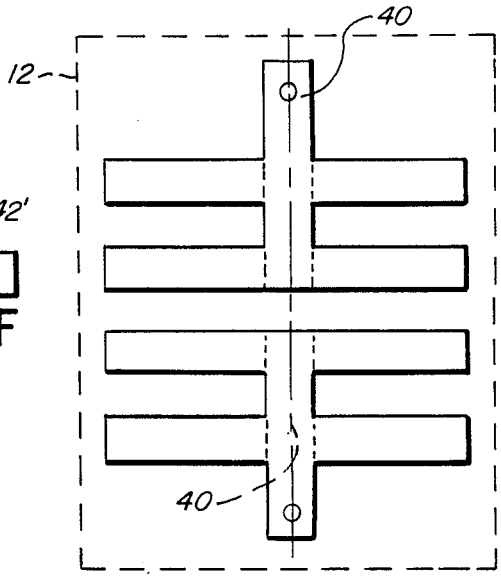
Figure 18B:
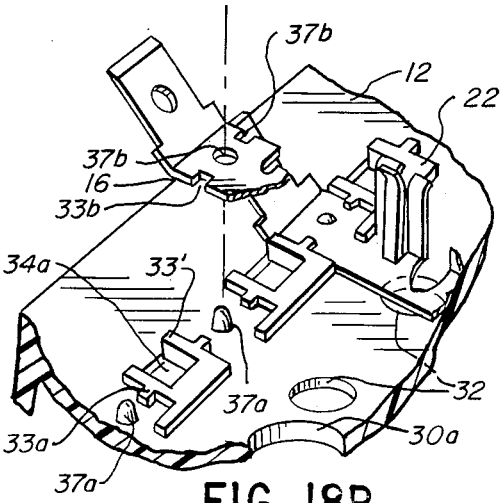

From the foregoing description, it will be observed that numerous variations and modifications may be effected without departing from the true spirit and scope of the novel concept of the invention. For example, FIG. 14A shows how the terminal plate may be formed to have terminals 22' and 24' for accepting a cylindrical type fuse. Of course, a different cover would be used. Other fuse accepting terminals (i.e., bifurcations), fuses and plug-in circuit elements (e.g., circuit breakers, disconnects, jumpers, etc.) may be accommodated. As another example, FIG. 16 depicts an embodiment wherein two formed metal blanks are located at opposite ends of a common insulated base 12; thus, two or more power sources may be protected from the same fuse block. In a similar fashion, FIG. 18B illustrates an embodiment wherein the alignment recesses 33' on the insulated cover 12 are provided with two oppositely disposed extensions which fit within two oppositely disposed recesses **33*b* in fuse terminal member 16'**. It should be understood that no limitation with respect to the specific apparatus illustrated herein is intended or should be inferred. It is, of course, intended to cover by the appended claims all such modifications as fall within the scope of the claims.

I claim:

1. A method of making a holder for a plurality of plug-in electrical circuit protective devices for interrupting the flow of current flowing therethrough, comprising the steps of:

(a) forming, from a blank of electrically conductive material, at least two branches which are separated from each other by a spaced distance and which are joined to a common trunk member, each of said branches having a free end and two edges which join said free end to said trunk member;

(b) forming, along at least one edge of each branch of said blank, a pair of spaced apart terminals which are adapted to removably receive the ends of a common plug-in electrical circuit protective device;

(c) mounting said branches and said trunk of said blank on a generally flat insulated base; and (d) splitting each branch at a position intermediate its terminals to form a plurality of severed branch portions and attached branch portions which are carried by said insulated base, whereby those terminals of each attached branch portion are joined to said trunk member and are connected to each other to form a common electrical supply bus (e) positioning an insulated member, on said base, to cover all but said free end of each severed branch portion and at least part of said severed branch portions and said trunk member of said blank, said insulated member having at least one aperture therein of sufficient size to receive one plug-in electrical circuit protective device; and (f) aligning said insulated member to have said at least one aperture over one pair of said spaced apart terminals.

2. A method of making a holder for a plurality of removable electrical circuit protective devices, comprising the steps of:

(a) forming, from a blank of electrically conductive material, at least two branches which are separated from each other by a spaced distance and which are joined to a common trunk member, each of said branches having a free end and two edges which join said free end to said trunk member;

(b) forming, along at least one edge of each of said at least two branches, a pair of spaced apart terminals which are adapted to receive the ends of a removable electrical circuit protective device;

(c) forming an electrical terminal at the free end of at least one branch;

(d) mounting said branches and said trunk of said blank on an insulated base; and (e) splitting each branch at a position intermediate its spaced apart terminals such that two separated branch portions are formed, whereby at least one spaced apart terminal remains joined to said trunk member to form an electrical supply terminal and said electrical terminal at said free end of said at least one branch is joined to only the other spaced apart terminal on said at least one branch.

3. The method of claim 2, wherein before step (c) the following steps are performed in any order:

(b1) forming at least one alignment aperture in each branch; and (b2) forming at least one alignment aperture in said trunk member.

4. The method of claim 2, where in performing step (a) said branches are formed generally parallel to each other and generally perpendicular to said trunk member.

5. The method of claim 4, where in performing step (b) said terminals are formed along non-adjacent edges of each branch and are formed generally perpendicular to a plane of each branch.

6. The method of claim 2, wherein step (a) is performed by:

(aa) stamping a generally flat rectangular blank of metal, on at least one side of a longitudinal reference line, to form a plurality of parallel branches which are spaced apart from each other, each of said branches being joined to a common electrically conductive trunk member in which said reference line lies, each of said branches having marginal portions defining a relatively short free end and two relatively long edges which join said free end to said conductive base.

7. The method of claim 6, where in step (aa) said branches are formed to be generally rectangular, are formed on two sides of said reference line, and are formed generally at right angles to said reference line.

8. The method of claim 7, where in step (aa) said trunk member is formed to be generally flat and rectangular and to have two short ends and two long ends, said branches are formed along said long ends, and at least one branch is formed at a location adjacent a short end; and further including the step of severing from said trunk member said at least one branch which is formed at a location adjacent said short end.

9. The method of claim 2, wherein step (b) is performed by:

(bb) forming, along one edge of each branch of said blank, a pair of bifurcations which are adapted to receive the terminals of a plug-in fuse of the type having pressure clip terminals, said bifurcations being disposed generally at right angles to a plane of said blank and being separated from each other by a predetermined distance generally equal to the distance between said pressure clip terminals of said plug-in fuse.

10. The method of claim 9, where in step (a) at least two lateral branches are formed on each side of a longitudinal reference line lying in said trunk member; and where in step (bb) said bifurcations are formed along nonadjacent edges of each lateral branch.

11. The method of claim 2, wherein step (b) includes the step of forming in said least one branch a section of reduced width at a location intermediate said spaced apart terminals;

wherein said insulated base has at least one aperture, and in step (c) said one branch is mounted on said insulated base to have said one aperture located under said section at reduced width; and wherein step (e) is performed by die stamping said section of reduced width at a position over said at least one aperture in said insulated base.

12. The method of claim 2, wherein step (a) includes the step of forming a locating aperture adjacent the free end of at least one branch; and wherein step (d) includes the step of positioning said locating aperture over an insulated base having at least one upward projection located thereon.

13. The method of claim 2, wherein said electrical circuit protective devices are plug-in fuses having two spaced-apart downwardly disposed blades; and wherein each terminal formed in step (b) comprises a pair of spaced apart upwardly disposed bifurcations which are adapted to receive said blades.

14. The method of claim 2, wherein prior to step (d) the following step is performed:

(cc) forming an insulated base having a generally flat surface, having a plurality of die stamping apertures and having aligning means for locating said branches over said die stamping apertures of said base at a position intermediate said spaced apart terminals.

15. The method of claim 14, wherein step (cc) includes the step of forming a cover securing aperture in said surface of said insulated base; and further including the step of:

(f) forming an insulated cover comprising a top wall having a plurality of circuit protective device receiving apertures which are adapted to carry protective devices therein, comprising a side wall which is joined to said top wall and which has a tab which is adapted to be received in said cover securing aperture in said insulated base, said cover securing aperture being located in said insulated base so that said electrical terminal at the free end of said one branch is exposed when said cover is joined to said insulated base, and comprising a barrier wall which is joined to said top wall and which is disposed between said insulated base and said top wall and between said pair of spaced apart terminals when said cover is joined to said insulated base.

16. The method of claim 15, wherein said step of forming aligning means in said base is performed by forming a plurality of projections on said surface of said insulated base; and wherein the cover of step (f) is formed to have means for receiving said projections to secure said electrical terminal at the free end of said one branch between said cover and said insulated base.

17. The method of claim 2, wherein prior to step (d) the following step is performed:

(cc) forming an insulated base having a plurality of die stamping apertures, having a plurality of securing apertures therein, and having at least one alignment projection for aligning said blank on said base to have said die stamping apertures located intermediate the ends of said terminals of each branch; and further including the step of (f) forming a wall having attaching means for attaching said wall to said securing apertures in said insulated base and having means for receiving said one projection to secure said electrical terminal at the free end of said one branch between said wall and said base.

18. The method of claim 17, wherein step (a) includes the step of forming an alignment aperture in said blank; and step (d) includes the step of locating said alignment aperture of said blank to receive said alignment projection of said base.

19. A method of making a holder for a plurality of plug-in circuit elements, comprising the steps of:

(a) forming, from a blank of electrically conductive material, at least two branches which are separated from each other by a spaced distance and which are joined to a common trunk member, each of said branches having a free end and two edges which join said free end to said trunk member;

(b) forming, along at least one edge of each branch of said blank, one pair of spaced apart terminals which are adapted to receive the ends of a plug-in circuit element;

(c) mounting said branches and said trunk of said blank on an insulated base;

(d) splitting each branch at a position intermediate its spaced apart terminals such that two separated branch portions are formed, the terminal of each branch portion which remains joined to said trunk member forming common electrical supply bus terminals;

(e) positioning, on said base, an insulated member to cover at least part of said trunk member and said branch portions, said insulated member having a top and at least one wall which is joined to said top, said top having at least one aperture located therein for receiving a plug-in circuit element for one pair of said spaced apart terminals; and (f) positioning said insulated member to have said at least one wall disposed between the free end of at least one branch and that spaced apart terminal which is joined to said free end such that said free end is exposed.

20. The method of claim 19, wherein said insulated member includes a plurality of tabs and said insulated base includes slot means aligned with said tabs of said insulated member for attaching said insulated member onto said insulated base; and further including the step of (g) inserting said tabs into said slot means.

21. The method of claim 19, wherein said insulated member has a second wall which is joined to said top at a location generally bisecting said at least one aperture; and step (e) includes the step of positioning said insulated member on said base such that said second wall is located between said terminals of said one pair.

22. A method of making a holder for a plurality of plug-in electrical safety means for performing a fuse function, comprising the steps of:

(a) forming, from a blank of electrically conductive material, at least two branches which are separated from each other by a spaced distance and which are joined to a common trunk member, each of said branches having a free end and two edges which join said free end to said trunk member;

(b) forming, along at least one edge of each branch of said blank, a pair of spaced apart terminals which are adapted to receive the ends of plug-in electrical safety means;

(c) performing the two steps which follow in any order:

(c1) forming at a predetermined location in said trunk member an aperture to receive the threaded end of a threaded fastener, and (c2) mounting the head of a threaded fastener on an insulated base such that the threaded end of said fastener and at least part of said head are exposed and said threaded fastener is not free to rotate relative to said insulated base;

(d) mounting said branches and said trunk of said blank on said insulated base with said threaded end of said threaded fastener passing through said aperture in said trunk member and said part of said head in contact with said trunk member; and (e) splitting each branch at a position intermediate its terminals such that two electrically separated branch portions are formed.

* * * * *